US006349582B2

(12) United States Patent
Tanaka et al.

(10) Patent No.: US 6,349,582 B2
(45) Date of Patent: Feb. 26, 2002

(54) DIE SYSTEM FOR FULL ENCLOSED DIE FORGING

(75) Inventors: Kunihiko Tanaka; Isamu Matumoto, both of Ishikawa (JP)

(73) Assignee: Komatsu, Ltd. (JP)

( * ) Notice: Subject to any disclaimer, the term of this patent is extended or adjusted under 35 U.S.C. 154(b) by 0 days.

(21) Appl. No.: 09/302,988

(22) Filed: Apr. 30, 1999

(30) Foreign Application Priority Data

May 6, 1998 (JP) ..... 10-123078

(51) Int. Cl.[7] ..... B21J 9/12
(52) U.S. Cl. ..... 72/30.1; 72/355.6
(58) Field of Search ..... 72/354.6, 355.2, 72/355.6, 357, 21.5, 30.1

(56) References Cited

U.S. PATENT DOCUMENTS

| | | | | |
|---|---|---|---|---|
| 2,333,529 A | * 11/1943 | Ernst | | 72/30.1 |
| 5,031,431 A | * 7/1991 | Naito | | 72/21.5 |
| 5,746,085 A | * 5/1998 | Harada et al. | | 72/355.6 |
| 5,823,104 A | * 10/1998 | Beisel et al. | | 72/21.5 |

FOREIGN PATENT DOCUMENTS

| | | | |
|---|---|---|---|
| JP | 55-128341 | * 10/1980 | 72/357 |
| JP | 60-30545 | * 2/1985 | 72/355.6 |
| JP | 60-216945 | * 10/1985 | 72/354.6 |
| JP | H5-154598 A | 6/1993 | |
| JP | 2534899 B2 | 6/1996 | |

* cited by examiner

*Primary Examiner*—Lowell A. Larson
(74) *Attorney, Agent, or Firm*—Rager, Fishman & Grauer PLLC; Ronald P. Kananen, Esq.

(57) ABSTRACT

A die system for full enclosed die forging with an enclosed cavity (1*a*, 2*a*) is formed between an upper die (1) attached to the side of a slide (6) and a lower die (2) mounted to the side of a bolster (17). A workpiece stock (7) disposed in the cavity is pressurized to be diverted with an upper counter-punch (8) in the upper die and a lower counter-punch (22) in the lower die and is thereby forged within the confines of the cavity. A pressure means (11, 19) is disposed above the upper die (1) and/or below the lower die (2) for applying pressure to at least one of the upper and lower dies (1, 2) from at least one of their upper and lower sides to act to enclose or close the cavity (1*a*, 2*a*) unilaterally or bilaterally. A back pressure imparting means (12, 20) is disposed above the upper counter-punch (8) and/or below the lower counter-punch (22) for applying back pressure to at least one of the upper and lower counter-punches (8, 22) to force the workpiece stock (7) being formed to be diverted unilaterally or bilaterally in the cavity. A back pressure removal means (33, 36) is associated with the back pressure imparting means (12, 20) to remove the back pressure upon the workpiece stock filling the cavity. An ensuing intense force of enclosure provides a forged product that is free of void and is of high quality.

6 Claims, 5 Drawing Sheets

DIE SYSTEM FOR FULL ENCLOSED DIE FORGING

TECHNICAL FIELD

The present invention relates in general to a die system for full enclosed die forging and more particularly to a forging die system for particular use in a stock diversion (diffluence) full enclosed die forging process in which a workpiece stock is allowed to divert in a full enclosed die cavity formed with and by means of a pair of dies.

BACKGROUND ART

Machine components such as gears have customarily be manufactured by a forging or extrusion process as known in the art. Conventional techniques that fall in this genre are described, for example, in Japanese patent literature No. JP H5-154598 A and No. JP 2534899 B2.

Patent literature No. JP H5-154598 A describes a forging method of manufacturing a spur gear that includes a first working step of upsetting a workpiece in a single die and forming it into a primarily worked gear that is smaller in gear contour geometry than the spur gear to be obtained. The method includes a second working step of compression molding the primarily worked gear in a single die while permitting the workpiece stock to freely flow (divert) in the area of it other than its gear forming area in the die to provide a fabricated gear. In the third working step of the method, the fabricated gear is drawn with a single die and formed into the end gear product. The first, second and third working steps are advantageously performed each by cold forging to permit an appropriate drawing allowance for the third working process step to be provided with constancy and maintained, which is described to allow products spur gears to be obtained consistently with an increased accuracy.

Patent literature No. JP 2534899 B2 describes a method for forming by extrusion a mechanical component in which a workpiece in a single die is extruded by means of a punch in the form of a hollow or bored cylinder to produce a raised portion of the mechanical component with the central bore of the punch. The workpiece is further extruded in the die while an open end region of the raised portion is held under a given pressure and the pressure is then reduced or released prior to completion of the extrusion process. This method is described to have an effect of providing the ability to largely reduce the maximum load acting on the die in a region of the lower dead point of the extrusion stroke.

These conventional techniques are found to be unsatisfactory, however, as having certain disadvantages.

Thus, the forging method described in JP H5-154598 A in which a workpiece stock must be preliminarily formed into a gear contour geometry that is smaller than that of a spur gear to be obtained, makes several process steps indispensable to perform including one or two sub-steps for preparing a primarily molded gear, and three successive steps forging. Disadvantageously enough, therefore, the method makes the process time-consuming and is thus poor in productivity.

Also, the need to replaceably use a number of different combinations of dies and punches for the different forging steps necessitates their troublesome or otherwise complicated exchanging procedures and requires preparation not only of these dies and punches in combination but also their individual mandrels, thus making the method costly with respect to the die system expenditure as well.

On the other hand, in the extrusion method described JP 2534899 B2, use is made of a pressure member associated with an upper punch to apply a pressure to the workpiece to cause it to be extruded rearwards with the workpiece stock flowing as in part constricted (diverting). The pressure member described is designed to apply to the workpiece stock a pressure that remains high until the extrusion process is almost complete and then it is reduced or removed, which may adversely act on a die to the extent that the die can inconveniently seize or become quickly unusable.

Also, the construction in which such a pressure member is only associated with the upper punch tends to cause an imbalance in pressure between the upper and lower punches. Then, causing a stock material to divert or flow only in one direction, this system may give rise to an unevenness of fiber flows in an end product, thus inconveniently reducing its strength and tending to develop a defect such as a crack or a surface sink in it.

SUMMARY OF THE INVENTION

It is accordingly an object of the present invention to overcome these inconveniences in the prior art by providing a die apparatus for full enclosed die forging process in which a pressure means produces an intense force of enclosure and whereby mechanical components that are free of defect and excellent in quality can readily be obtained.

This and other objects are attained in accordance with the present invention by a die system for full enclosed or closed die forging in which an enclosed cavity is formed between an upper die attached to the side of a slide and a lower die mounted to the side of a bolster, and a workpiece stock disposed in the cavity is pressurized to be diverted with an upper counter-punch in the upper die and a lower counter-punch in the lower die and is thereby forged within the confines of the cavity, which system comprises: a pressure means disposed in at least one of a first region above the said upper die and a second region below the said lower die for applying pressure to at least one of the said upper and lower dies from at least one of their upper and lower sides to act to enclose or close the said cavity at least unilaterally; a back or backing pressure imparting means disposed in at least one of a third region above the said upper counter-punch and a fourth region below the said lower counter-punch for applying back pressure to at least one of the said upper and lower counter-punches to force the said workpiece stock being formed to be diverted at least unilaterally in the said cavity; and a back pressure removal means associated with the said back pressure imparting means for removing the said back pressure upon the said workpiece stock filling said cavity.

In performing the process of forging a workpiece stock using the arrangement described, the upper die may be lowered with the slide to bring the upper and lower dies into close and firm contact. An enclosed cavity that accommodates the workpiece stock in it is formed thereby. A pressure applied to at least one of the upper and lower dies tends to enclose or close the cavity at least unilaterally. Under a back pressure then exerted to at least one of the upper and lower counter-punches, the workpiece stock is forced to be diverted at least unilaterally and flow out within the cavity. Upon the workpiece stock as the result of diversion filling the cavity, the back pressure on the at least one of the upper and lower counter-punches is removed. An abnormal rise of pressure in the cavity is thereby prevented. The ability by the pressure means under an elevated pressure to readily achieve an intense force of enclosure or closing makes the system particularly advantageous in producing a large machine part by forging. As any adverse build-up of high pressure after the cavity is filled up with the workpiece stock is avoided by the back pressure removal means, any consequential adverse effects such as a damage to a die or disadvantage of the die becoming quickly useless are effectively prevented.

Also, the ability of the system to maintain a large and sufficient force of enclosure or closing until the slide reaches its lower dead point ensures yielding a forged or formed product that is free of void and is excellent in quality. Also, since a product yielded is free of burr, any work required to perform burr removal that is typical in a conventionally forged product is dispensed with.

Further, hydraulic or fluid pressure only needs to be produced during each forging operation alone. This allows die mounting components to be smaller in size, thus rendering the entire die system less costly.

Preferably in the system described, the said pressure means comprises a first pressure means disposed above the said upper die for applying pressure to the said upper die from its upper side and a second pressure means disposed below the said lower die for applying pressure to the said lower die from its lower side, the said first and second pressure means pressurizing and thereby acting to enclose or close the said cavity bilaterally; the said back imparting pressure means comprises a first back pressure imparting means disposed above the said upper counter-punch for applying back pressure to the said upper counter-punch from its upper side and a second back pressure imparting means disposed below the said lower counter-punch for applying back pressure to the said lower counter-punch from its lower side, the said first and second back pressure imparting means forcing the said workpiece stock being formed to be diverted bilaterally in the said cavity; and the said back pressure removal means is adapted to act on the said first and second back pressure imparting means for removing each said back pressure upon the said workpiece stock filing the said cavity.

This arrangement permits fluid pressure to be applied to the upper and lower pressure means simultaneously to actuate both the upper and lower dies to enclose and hence makes only a single unit of fluid pressure supply sufficient to actuate them. A reduction in the equipment cost can thereby be achieved.

It is also advantageous: if the said pressure means is disposed below the said lower die for applying pressure to the said lower die from its lower side to act to enclose or close the said cavity unilaterally; the said back pressure imparting means comprises a first back pressure imparting means disposed above the said upper counter-punch for applying back pressure thereto and a second back pressure imparting means disposed below the said lower counter-punch for applying back pressure thereto, the said first and second back pressure imparting means forcing the said workpiece stock being formed to be diverted bilaterally in the said cavity; and the said back pressure removal means is adapted to act on the said first and second back pressure imparting means for removing each said back pressure upon the said workpiece stock filling the said cavity.

It is also advantageous if: the said pressure means is disposed above the said upper die for applying pressure to the said upper die from its upper side to act to enclose or close the said cavity unilaterally; the said back pressure imparting means comprises a first back pressure imparting means disposed above the said upper counter-punch for applying back pressure thereto and a second back pressure imparting means disposed below the said lower counter-punch for applying back pressure thereto, the said first and second back pressure imparting means forcing the said workpiece stock being formed to be diverted bilaterally in the said cavity; and the said back pressure removal means is adapted to act on the said first and second back pressure imparting means for removing each said back pressure upon the said workpiece stock filling the said cavity.

It is also advantageous if: the said pressure means comprises a first pressure means disposed above the said upper die for applying pressure to the said upper die from its upper side and a second pressure means disposed below the said lower die for applying pressure to the said lower die from its lower side, the said first and second pressure means acting to enclose or close the said cavity bilaterally; the said back pressure imparting means is disposed above the said upper counter-punch for applying back pressure thereto to force the said workpiece stock being formed to be diverted unilaterally in the said cavity; and the said back pressure removal means is adapted to act on the said back pressure imparting means for removing the said back pressure upon the said workpiece stock filling the said cavity.

It is also advantageous if: the said pressure means comprises a first pressure means disposed above the said upper die for applying pressure to the said upper die from its upper side and a second pressure means disposed below the said lower die for applying pressure to the said lower die from its lower side, the said first and second pressure means acting to enclose or close the said cavity bilaterally; the said back pressure means is disposed below the said lower counter-punch for applying back pressure thereto to force the said workpiece stock being formed to be diverted unilaterally in the said cavity; and the said back pressure removal means is adapted to act on the said back pressure imparting means for removing the said back pressure upon the said workpiece stock filling the said cavity.

It is also advantageous if: the said pressure means is disposed above the said upper die for applying pressure to the said upper die from its upper side to act to enclose or close the said cavity unilaterally; the said back pressure imparting means is disposed above the said upper counter-punch for applying back pressure thereto to force the said workpiece stock being formed to be diverted unilaterally in the said cavity; and the said back pressure removal means is adapted to act on the said back pressure imparting means for removing the said back pressure upon the said workpiece stock filling the said cavity.

It is also advantageous if: the said pressure means is disposed below the said lower die for applying pressure to the said lower die from its lower side to act to enclose or close the said cavity unilaterally; the said back pressure imparting means is disposed below the said lower counter-punch for applying back pressure thereto to force the said workpiece stock being formed to be diverted unilaterally in the said cavity; and the said back pressure removal means is adapted to act on the said back pressure imparting means for removing the said back pressure upon the said workpiece stock filling the said cavity.

It is also advantageous if: the said pressure means is disposed above the said upper die for applying pressure to the said upper die from its upper side to act to enclose or close the said cavity unilaterally; the said back pressure imparting means is disposed below the said lower counter-punch for applying back pressure thereto to force the said workpiece stock being formed to be diverted unilaterally in the said cavity; and the said back pressure removal means is adapted to act on the said back pressure imparting means for removing the said back pressure upon the said workpiece stock filling the said cavity.

It is further advantageous if: the said pressure means is disposed below the said lower die for applying pressure to the said upper die from its lower side to act to enclose or close the said cavity unilaterally; the said back pressure imparting means is disposed below the said lower counter-punch for applying back pressure thereto to force the said workpiece stock being formed to be diverted unilaterally in the said cavity; and the said back pressure removal means is adapted to act on the said back pressure imparting means for removing the said back pressure upon the said workpiece stock filling the said cavity.

BRIEF DESCRIPTION OF THE DRAWINGS

The present invention will better be understood from the following detailed description and the drawings attached hereto showing certain illustrative embodiments of the present invention. In this connection, it should be noted that such embodiments as illustrated in the accompanying drawings hereof are intended in no way to limit the present invention but to facilitate an explanation and understanding thereof.

In the accompanying drawings.

BEST MODES FOR CARRYING OUT THE INVENTION

Hereinafter, suitable embodiments of the present invention implemented with respect to a die system for full enclosed die forging are set out with reference to the accompanying drawings hereof.

Figure 1:
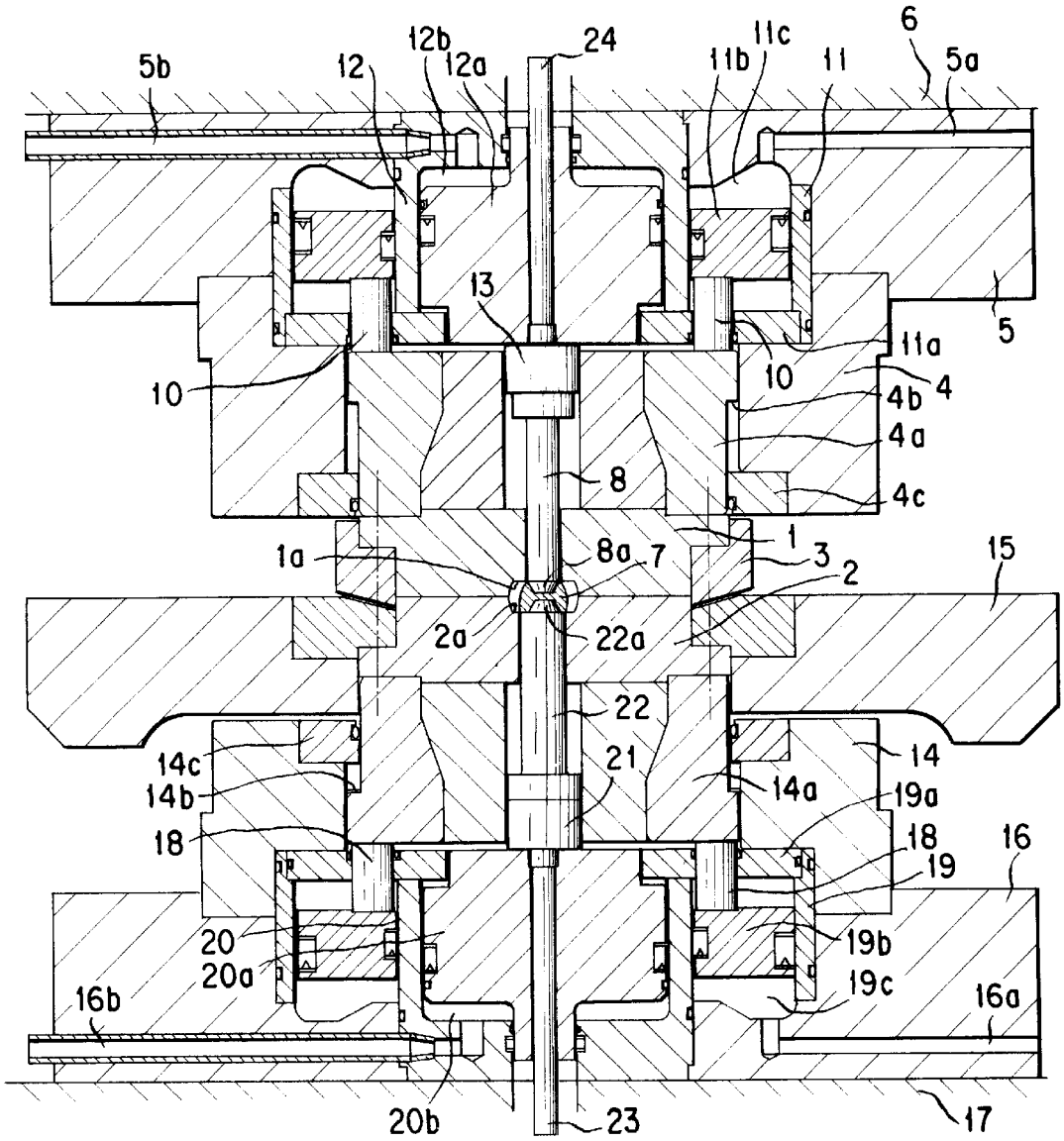
FIG. 1 is a cross sectional view illustrating a die system for full enclosed die forging representing a first form of embodiment of the present invention.
Figure 2:
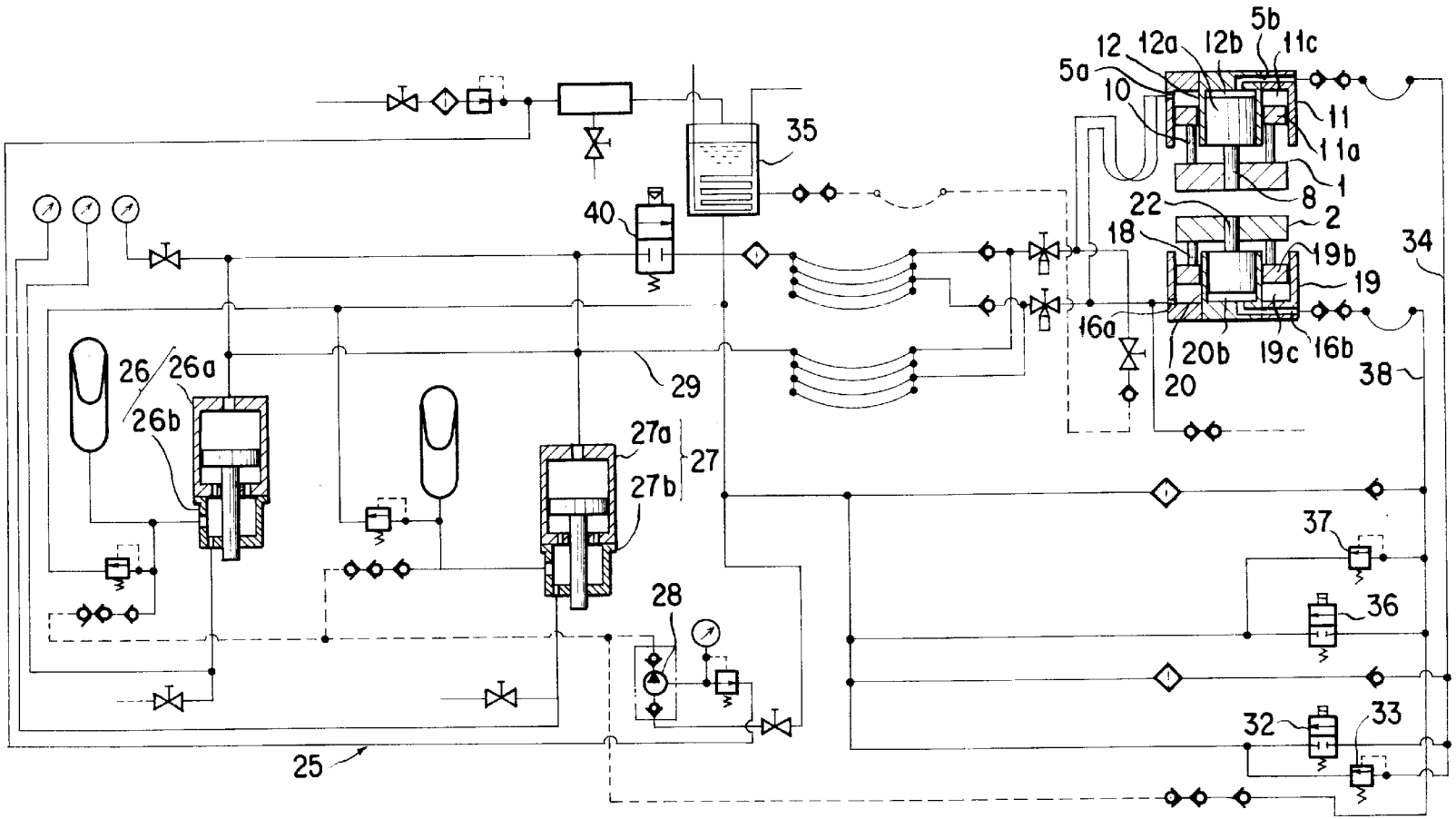
FIG. 2 is a circuit diagram for a fluid pressure generating apparatus for use with the die system for full enclosed die forging illustrated in FIG. 1.

Referring now to FIGS. 1 and 2, a first form of embodiment will be described in detail.

A die system for full enclosed die forging shown in cross section in FIG. 1 is operable to effect bilateral enclosure and bilateral diversion and may be operated with a fluid pressure generating circuit arrangement shown in FIG. 2. Typical mechanical components produced by a forging process performed using such a die system include inner races for even speed joints, bevel gears, flange parts and so forth.

In FIGS. 1 and 2 an upper and a lower die are designated by reference numerals 1 and 2, respectively. The upper die 1 is detachably attached, by means of an upper die holder 3, to the lower surface of an upper die support member 4. The upper die support member 4 is attached, by means of an upper cylinder block 5, to the lower surface of a slide 6 provided in a conventional forging press.

The upper die 1 is formed in its lower central area with a cavity half 1*a* while the lower die 2 is formed in its upper central area with a cavity half 2*a*, the cavity halves 1*a* and 2*a* together constituting a cavity for forming a workpiece stock 7.

Extending centrally through the upper die 1 and slidably supported thereby is an upper counter-punch 8 that is movable vertically to have its tapered lower end 8*a* entering and leaving the cavity half 1*a* as it is moved downwards and upwards.

The upper die support member 4 accommodates an elevating member 4*a* movable vertically to move the upper die 1 upwards and downwards. The upper die 1 is attached to the lower surface of the elevating member 4 by means of the die holder 3. The elevating member 4*a* has its outer peripheral surface provided with a step formation 4*b*, and a stop ring 4*c* is securely fitted in the lower end of the upper die support member 4*a* to hold the stepped formation 4*b* and thereby to prevent the elevating member 4*a* from coming off within the upper die support member 4. A plurality of operating pins 10 are arranged having their lower end surfaces in contact with the upper surface of the elevating member 4*a*.

The operating pins 10 are arranged to vertically pass through the end plate 11*a* of an outer cylinder 11 provided in the cylinder block 5. The operating pins 10 have their upper end faces arranged in contact with the lower end face of a piston 11*b* that is slidably received in the outer cylinder 11 so as to be movable upwards and downwards.

The upper side of the piston 11*b* defines a fluid pressure chamber 11*c* that is connected via a fluid passage 5*a* formed in the cylinder block 5 and then via a pipe conduit 29 to a fluid pressure generator 25 shown in FIG. 2.

Inside of the outer cylinder 11 an inner cylinder 12 is arranged concentrically therewith. A piston 12*a* is received slidably in the inner cylinder 12 so as to be movable upwards and downwards and has its lower end face held in contact with a pusher member 13 whose lower end face is in turn held in contact with the upper end face of the upper counter-punch 8. Centrally of the piston 12*a*, a pin 24 is slidably received so as to be movable vertically therethrough, the pin 24 representing a knock-out pin of a slide knock-out (not shown) typically provided in the slide 6.

The upper side of the piston 12*a* defines a fluid pressure chamber 12*b* filled preliminarily with a fluid. The fluid pressure chamber 12*b* is connected via a fluid passage 5*b* formed in the cylinder block 5 and then as shown in FIG. 2 via a pipe conduit 34 in which a first electromagnetic valve 32 and a relief valve 33 are connected in parallel to a fluid reservoir 35 for the fluid pressure generator 25.

On the other hand, the lower die 2 is mounted by means of a lower die holder 15, on the upper surface of a lower elevating member 14*a* that is received in a lower die support member 14 so as to be movable vertically. The lower die support member 14 is mounted on a lower cylinder block 16 that is in turn mounted on the upper surface of a bolster 17 in the forging press.

The elevating member 14*a* has its outer peripheral surface provided with a stepped formation 14*b*, and a stop ring 14*c* is securely fitted in the upper end of the lower die support member 14*a* to hold the stepped formation 14*b* and thereby to prevent the elevating member 14*a* from coming off upwards. A plurality of operating pins 18 are arranged having their upper end surfaces in contact with the lower surface of the elevating member 14*a*.

The operating pins 18 are arranged to vertically pass through the end plate 19*a* of an outer cylinder 19 provided in the cylinder block 16. The operating pins 18 have their lower end faces arranged in contact with the upper end face of a piston 19*b* that is slidably received in the outer cylinder 19 so as to be movable upwards and downwards.

The lower side of the piston 19*b* defines a fluid pressure chamber 19*c* that is connected via a fluid passage 16*a* formed in the cylinder block 16 and then via a pipe conduit 29 to a fluid pressure generator 25 shown in FIG. 2.

Inside of the outer cylinder 19 an inner cylinder 20 is arranged concentrically therewith. A piston 20*a* is received slidably in the inner cylinder 20 so as to be movable upwards and downwards and has its upper end face held in contact with a pusher member 21 whose upper end face is in turn held in contact with the lower end face of a lower counter-punch 22.

The lower counter-punch 22 is arranged to be movable vertically to have its tapered upper end 22*a* entering and leaving the cavity half 2*a* as it is moved upwards and downwards. Centrally of the piston 20*a*, a pin 23 is slidably received so as to be movable vertically therethrough, the pin 23 representing a knock-out pin of a bed knock-out (not shown) typically provided in the bed of the forging press.

The lower side of the piston 20*a* defines a fluid pressure chamber 20*b* filled preliminarily with a fluid. The fluid pressure chamber 20*b* is connected via a fluid passage 16*b* formed in the cylinder block 16 and then as shown in FIG. 2 via a pipe conduit 38 in which a second electromagnetic valve 36 and a relief valve 37 are connected in parallel to the fluid reservoir 35 for the fluid pressure generator 25.

The fluid pressure generator 25 comprises a moderate pressure generating means 26 having a pair of cylinders 26*a* and 26*b* which vary in diameter and a high pressure generating means 27 having a pair of cylinders 27*a* and 27*b* that vary in diameter. The cylinders 26*b* and 27*b* that are smaller in diameter are operable with pressure fluid supplied to produce a moderate and a high pressure in the cylinders 26*a* and 27*a*, respectively, that are larger in diameter. Pressure fluid flows at a moderate and a high pressure produced in the moderate and high pressure generating means 26 and 27 are supplied via the pipe conduit 29 into the fluid pressure chamber 11*c* for the outer cylinder 11 in the upper die 1 side and the fluid pressure chamber 19*c* for the outer cylinder 19 in the lower die 2 side.

A residual pressure that may remain in each of the moderate and high pressure generating means 26 and 27 is removed into the fluid reservoir 35 through a residual pressure removal valve indicated at 40 in FIG. 2.

An explanation is now given of an operation of the die system for full enclosed die forging with the construction above described.

With the slide 6 held standstill at its upper dead point, a workpiece stock 7 is introduced into the cavity 2*a* in the lower die 2 using a suitable transfer means (not shown). Then, the upper die 1 is allowed to descend by lowering the slide 6 to bring the lower surface of the upper die 1 into a firm contact with the upper surface of the lower die 2. In this state, pressure fluid is supplied from the moderate pressure generating means 26 or high pressure generating means 27 into the fluid pressure chambers 11*c* and 19*c* for the upper and lower outer cylinders 11 and 19 simultaneously to pressurize the upper and lower dies 2 from their upper and lower sides and thereby to act to enclose or close the cavity 1*a*, 2*a* from the both sides, in this case, to bilaterally act to enclose or close the cavity.

Then, a back or backing pressure is imparted to each of the upper counter-punch 8 projecting into the upper cavity half 1*a* and the lower counter-punch 22 projecting into the lower cavity half 2*a* to compress the workpiece stock 7 in the bilaterally enclosed die cavity 1*a*, 2*a* between the tapered lower and upper ends 8*a* and 22*a* of the upper and lower counter-punches 8 and 22. The workpiece stock 7 is thus forced to be diverted, here to be bilaterally diverted, into vacant spaces within the enclosed cavity 1*a*, 2*a*, thereby to allow the workpiece stock 7 to be forged in it.

Then, upon the workpiece stock 7 filling the cavity 1*a*, 2*a* as a result of diversion and immediately before its internal pressure rises, the first and second electromagnetic valves 32 and 36 are opened to permit the pressure fluid in the fluid pressure chambers 12*b* and 20*b* for the upper and lower inner cylinders 12 and 20 to drain into the fluid reservoir 35.

The back pressures on the upper and lower counter-punches 8 and 22 are thereby removed, thus terminating compression and diversion of the workpiece stock 7. Since the internal pressure no longer rises in the cavity, any damage to the dies and like disadvantages that may result from an abnormal pressure therein are here avoided.

After forming of the workpiece stock 7 by forging has been completed in this manner, the slide 6 is raised to lift the upper die 1. To commence lifting the upper die 1, the slide knock-out is actuated to push the knock-out pin 24 down, permitting the forged workpiece 7 adhered to the upper die 1 to be knocked out. While the formed workpiece 7 is further ascending, the bed knock-out is actuated to push the knock-out pin 23 up, permitting the workpiece 7 to be knocked out from the lower die 2. The product workpiece 7 is then removed from the system using the workpiece transfer apparatus.

The die system described that permits the forged workpiece products 7 to be obtained by repeating the foregoing operation. The forged products are free of defect and excellent in quality by virtue of the fact that forging is carried out with the upper and lower dies 1 and 2 forced to bilaterally enclose or close the die cavity and at the same time with the upper and lower counter-punches 14 and 22 acting to bilaterally divert the workpiece stock 7.

Figure 3:
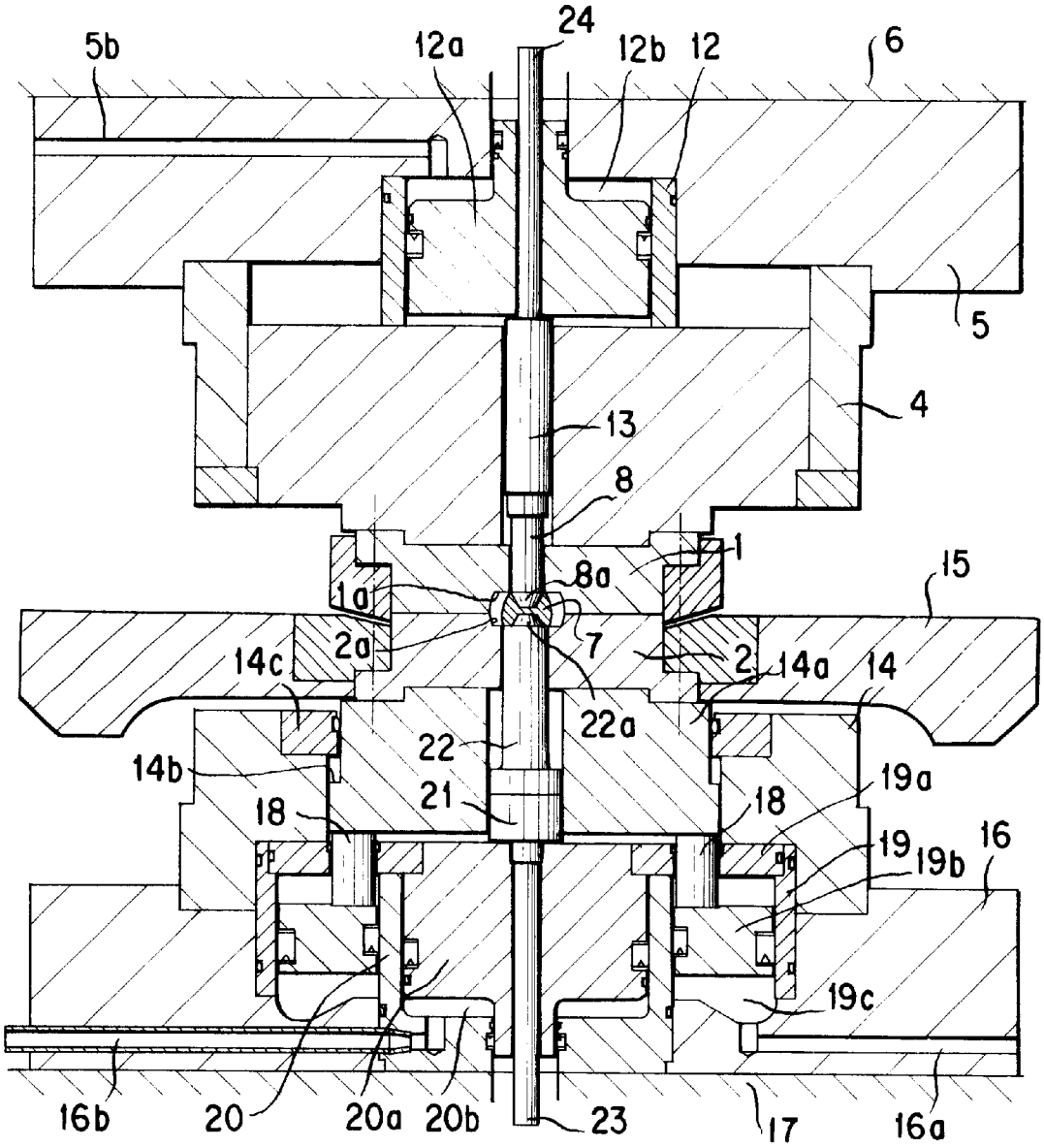
FIG. 3 is a cross sectional view illustrating a die system for full enclosed die forging representing a second form of embodiment of the present invention.
Figure 4:
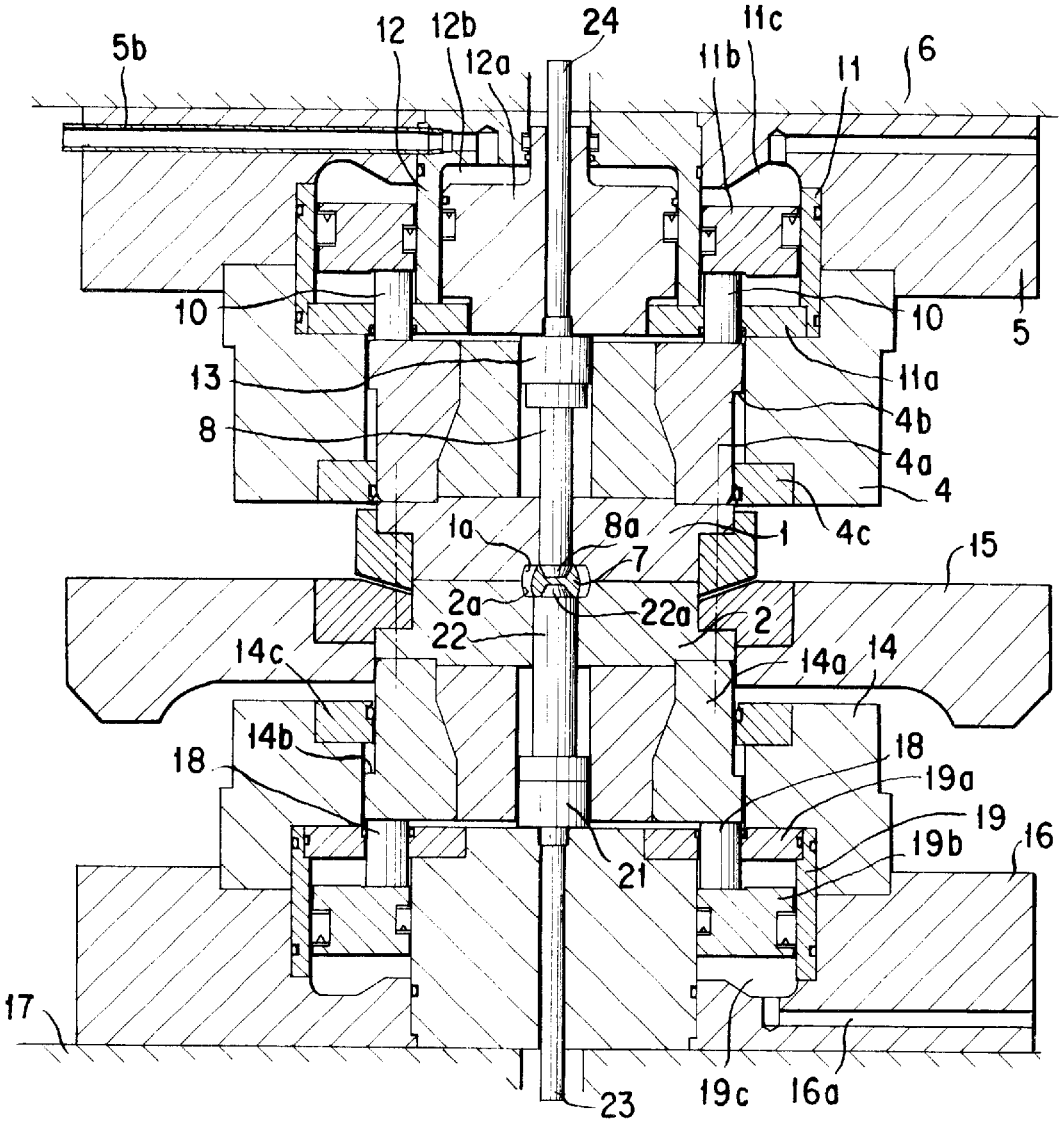
FIG. 4 is a cross sectional view illustrating a die system for full enclosed die forging representing a third form of embodiment of the present invention.
Figure 5:
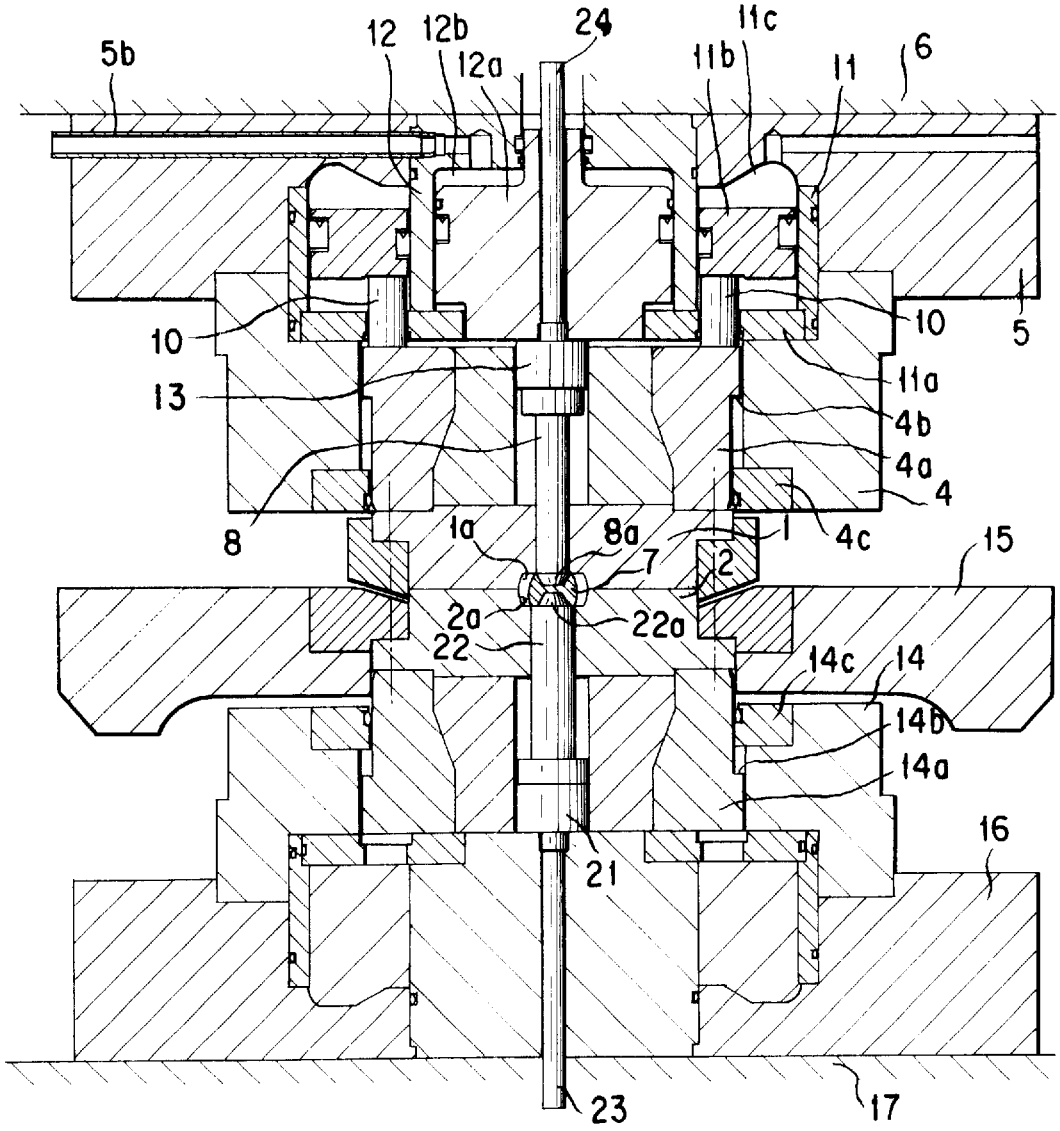
FIG. 5 is a cross sectional view illustrating a die system for full enclosed die forging representing a fourth form of embodiment of the present invention.

While the first form of embodiment of the invention described is shown to effect bilateral enclosure or closing by applying pressure simultaneously to the upper and lower dies 1 and 2 and exerting pressure simultaneously to the upper and lower counter-punches 8 and 22 from both the upper and lower sides, it is also advantageous if the present invention is embodied in any of alternative forms, i.e., by adopting unilateral enclosure or closing and bilateral diversion as shown in FIG. 3, bilateral enclosure and unilateral diversion as shown in FIG. 4 and unilateral enclosure and unilateral diversion as shown in FIG. 5.

In these alternative forms of embodiment shown which are explained below, it should be noted that the same reference characters are used to designate the same parts or components as used in the illustration and description of the first form of embodiment shown in FIGS. 1 and 2.

In the second form of embodiment of the invention shown in FIG. 3, pressure is applied only to the lower die 22, viz. with the piston 19*b* for the lower outer cylinder 19 from its lower side, to unilaterally act to enclose or close the cavity and simultaneously backing pressure is exerted to the upper and lower counter-punches 8 and 22 from their respective upper and lower sides to effect bilateral diversion in the workpiece stock 7. The feature that upon the workpiece stock filling the cavity 1*a*, 2*a* in which bilateral diversion on the workpiece stock 7 has been effected the back pressure on both of the upper and lower counter-punches 8 and 22 is removed by opening the first and second electromagnetic valves 32 and 36 is the same in this form of embodiment as in the first form of embodiment.

In a modification of this second form of embodiment that is also advantageous, pressure is applied to only the upper die 1, viz. with the piston lib for the upper outer cylinder 11 to unilaterally act to enclose or close the cavity and simultaneously back or backing pressure is exerted both to the upper and lower counter-punches 8 and 22 from their respective upper and lower sides to force the workpiece stock to be diverted bilaterally.

In the third form of embodiment of the invention shown in FIG. 4, pressure is applied simultaneously to the upper and lower dies 1 and 2 with the pistons 11*b* and 19*b* for the upper and lower outer cylinders 11 and 19 to unilaterally act to enclose or block the cavity 1*a*, 2*a* and simultaneously back or backing pressure is exerted only to the upper counter-punch 8 from its upper side to force the workpiece stock to be diverted into free spaces within the cavity 1*a*, 2*a*. Then, an electromagnetic valve arrangement of the type described may be used to remove the backing pressure on the upper counter-punch 8 upon the workpiece as a result of diversion filling the cavity 1*a*, 2*a* to prevent a rise in the internal stress in the cavity 1*a*, 2*a*.

In a modification of this third form of embodiment of the invention that is also advantageous, pressure is applied simultaneously to both the upper and lower dies 1 and 2 with the pistons 11*b* and 19*b* for the upper and lower outer cylinders 11 and 19 to bilaterally act to enclose or block the cavity and simultaneously back or backing pressure is exerted only to the lower counter-punch 22 from its lower side to force the workpiece stock to be diverted unilaterally.

In the forth form of embodiment of the invention shown in FIG. 5, pressure is applied only to the upper die 1 with the piston 11*b* for the upper outer cylinder 11 to unilaterally act to enclose or close the cavity 1*a*, 2*a* and simultaneously back or backing pressure is exerted only to the upper counter-punch 8 from its upper side to force the workpiece stock to be diverted into free spaces within the cavity 1*a*, 2*a*. Then, an electromagnetic valve arrangement of the type described may be used to remove the backing pressure on the upper counter-punch 8 upon the workpiece as a result of diversion filling the cavity 1*a*, 2*a* to prevent a rise in the internal stress in the cavity 1*a*, 2*a*.

In a modification of this fourth form of embodiment of the invention that is also advantageous, pressure is applied only to the lower die 2 with the pistons 19*b* for the lower outer cylinder 19 to unilaterally act to enclose or close the cavity 1*a*, 2*a* and simultaneously back or backing pressure is exerted only to the lower counter-punch 22 from its lower side to force the workpiece stock to divert unilaterally. In another modification of this fourth form of embodiment of the invention that is also advantageous, pressure is applied only to the upper die 1 with the pistons 11*b* for the lower outer cylinder 11 to unilaterally act to enclose or close the cavity 1*a*, 2*a* and simultaneously back or backing pressure is exerted only to the lower counter-punch 22 is exerted only to the lower counter-punch 22 from its lower side to force the work piece stock to be diverted unilaterally.

In any of the forms of embodiment of the invention described, a formed product that is free of void or defect and excellent in quality is obtained.

While the present invention has hereinbefore been set forth with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the invention is not intended to be limited to the specific embodiments thereof set out above, but to include all possible embodiments thereof that can be made within the scope with respect to the features specifically set forth in the appended claims and encompasses all the equivalents thereof.

What is claimed is:

1. A die system for full enclosed die forging in which an enclosed cavity is formed between an upper die attached to the side of a slide and a lower die mounted to the side of a bolster, and a workpiece stock disposed in the cavity is pressurized to be diverted with an upper counter-punch in the upper die and a lower counter-punch in the lower die and is thereby forged within the confines of the cavity, the system comprising:

a pressure means disposed in at least one of a first region above said upper die and a second region below said lower die for applying pressure to at least one of said upper and lower dies from at least one of their upper and lower sides to act to enclose said cavity at least unilaterally; said pressure means comprises a first pressure means disposed from above said upper die applying pressure to said upper die from its upper side and a second pressure means diposed below said lower die for applying pressure to said lower die from its lower side, and first and second pressure means acting to enclose said cavity bilaterally;

a back pressure imparting means comprising a cylinder actuator disposed in at least one of a third region above said upper counter-punch and a fourth region below said lower counter-punch for applying back pressure to at least one of said upper and lower counter-punches to force said workpiece stock being formed to be diverted at least unilaterally in said cavity; said back imparting pressure means comprises a first back pressure imparting means disposed above said upper counter-punch for applying back pressure to said upper counter-punch from its upper side and a second back pressure imparting means disposed below said lower counter-punch for applying back pressure to said lower counter-punch from its lower side, said first and second back pressure imparting means forcing said workpiece stock being formed to be diverted bilaterally in said cavity; and a back pressure removal means comprising an electromagnetic valve via which a fluid pressure chamber of said cylinder actuator is connected to a fluid reservoir, for removing said back pressure immediately before an internal pressure of said cavity rises upon said workpiece stock filling said cavity, by opening said electromagnetic valve to permit a pressure fluid in said pressure chamber to drain into said reservoir, said back pressure removal means is adapted to act on said first and second back pressure imparting means for removing each said back pressuring upon said workpiece stock filing said cavity.

2. A die system for full enclosed die forging in which an enclosed cavity is formed between an upper die attached to the side of a slide and a lower die mounted to the side of a bolster, and a workpiece stock disposed in the cavity is pressurized to be diverted with an upper counter-punch in the upper die and a lower counter-punch in the lower die and is thereby forged within the confines of the cavity, the system comprising:

a pressure means disposed in at least one of a first region above said upper die and a second region below said lower die for applying pressure to at least one of said upper and lower dies from at least one of their upper and lower sides to act to enclose said cavity at least unilaterally; said pressure means is diposed below said lower die for applying pressure to said lower die from its lower side to act to enclose said cavity unilaterally;

a back pressure imparting means comprising a cylinder actuator disposed in at least one of a third region above said upper counter-punch and a fourth region below said lower counter-punch for applying back pressure to at least one of said upper and lower counter-punches to force said workpiece stock being formed to be diverted at least unilaterally in said cavity; said back pressure imparting means comprises a first back pressure imparting means disposed above said upper counter-punch for applying back pressure thereto and a second back pressure imparting means disposed below said lower counter-punch for applying back pressure thereto, said first and second back pressure imparting means forcing said workpiece stock being formed to be diverted bilaterally in said cavity; and a back pressure removal means comprising an electromagnetic valve via which a fluid pressure chamber of said cylinder actuator is connected to a fluid reservoir, for removing said back pressure immediately before an internal pressure of said cavity rises upon said workpiece stock filling said cavity, by opening said electromagnetic valve to permit a pressure fluid in said pressure chamber to drain into said reservoir, said back pressure removal means is adapted to act on said first and secon back pressure imparting means for removing each said back pressure upon said workpiece stock filling said cavity.

3. A die system for full enclosed die forging in which an enclosed cavity is formed between an upper die attached to the side of a slide and a lower die mounted to the side of a bolster, and a workpiece stock disposed in the cavity is pressurized to be diverted with an upper counter-punch in the upper die and a lower counter-punch in the lower die and is thereby forged within the confines of the cavity, the system comprising:

a pressure means disposed in at least one of a first region above said upper die and a second region below said lower die for applying pressure to at least one of said upper and lower dies from at least one of their upper and lower sides to act to enclose said cavity at least unilaterally; said pressure means comprises a first pressure means disposed above said upper die for applying pressure means disposed below said lower die for applying pressure to said lower die from its lower side, and first and second pressure means acting to enclose said cavity bilaterally;

a back pressure imparting means comprising a cylinder actuator disposed in at least one of a third region above said upper counter-punch and a fourth region below said lower counter-punch for applying back pressure to at least one of said upper and lower counter-punches to force said workpiece stock being formed to be diverted at least unilaterally in said cavity, said back pressure imparting means is disposed above said upper counter-punch for applying back pressure thereto to force said workpiece stock being formed to be diverted unilaterally in said cavity; and a back pressure removal means comprising an electromagnetic valve via which a fluid pressure chamber of said cylinder actuator is connected to a fluid reservoir, for removing said back pressure immediately before an internal pressure of said cavity rises upon said workpiece stock filling said cavity, by opening said electromagnetic valve to permit a pressure fluid in said pressure chamber to drain into said reservoir, said back pressure removal means is adapted to act on said back pressure imparting means for removing said back pressure upon said workpiece stock filling said cavity.

4. A die system for full enclosed die forging in which an enclosed cavity is formed between an upper die attached to the side of a slide and a lower die mounted to the side of a bolster, and a workpiece stock disposed in the cavity is pressurized to be diverted with an upper counter-punch in the upper die and a lower counter-punch in the lower die and is thereby forged within the confines of the cavity, the system comprising:

a pressure means disposed in at least one of a first region above said upper die and a second region below said lower die for applying pressure to at least one of said upper and lower dies from at least one of their upper and lower sides to act to enclose said cavity at least unilaterally, said pressure means comprises a first pressure means disposed above said upper die for applying pressure to said upper die from its upper side and a second pressure means disposed below said lower die for applying pressure to said lower die from its lower side, said first and second pressure means acting to enclose said cavity bilaterally;

a back pressure imparting means comprising a cylinder actuator disposed in at least one of a third region above said upper counter-punch and a fourth region below said lower counter-punch for applying back pressure to at least one of said upper and lower counter-punches to force said workpiece stock being formed to be diverted at least unilaterally in said cavity, said back pressure means is disposed below said lower counter-punch for applying back pressure thereto to force said workpiece stock being formed to be diverted unilaterally in said cavity; and a back pressure removal means comprising an electromagnetic valve via which a fluid pressure chamber of said cylinder actuator is connected to a fluid reservoir, for removing said back pressure immediately before an internal pressure of said cavity rises upon said workpiece stock filling said cavity, by opening said electromagnetic valve to permit a pressure fluid in said pressure chamber to drain into said reservoir, said back pressure removal means is adapted to act on said back pressure imparting means for removing said back pressure upon said workpiece stock filling said cavity.

5. A die system for full enclosed die forging in which an enclosed cavity is formed between an upper die attached to the side of a slide and a lower die mounted to the side of a bolster, and a workpiece stock disposed in the cavity is pressurized to be diverted with an upper counter-punch in the upper die and a lower counter-punch in the lower die and is thereby forged within the confines of the cavity, the system comprising:

a pressure means disposed in at least one of a first region above said upper die and a second region below said lower die for applying pressure to at least one of said upper and lower dies from at least one of their upper and lower sides to act to enclose said cavity at least unilaterally, said pressure means is disposed below said lower die for applying pressure to said lower die from its lower side to act to enclose said cavity unilaterally;

a back pressure imparting means comprising a cylinder actuator disposed in at least one of a third region above said upper counter-punch and a fourth region below said lower counter-punch for applying back pressure to at least one of said upper and lower counter-punches to force said workpiece stock being formed to be diverted at least unilaterally in said cavity, said back pressure imparting means is disposed below said lower counter-punch for applying back pressure thereto to force said workpiece stock being formed to be diverted unilaterally in said cavity; and a back pressure removal means comprising an electromagnetic valve via which a fluid pressure chamber of said cylinder actuator is connected to a fluid reservoir, for removing said back pressure immediately before an internal pressure of said cavity rises upon said workpiece stock filling said cavity, by opening said electromagnetic valve to permit a pressure fluid in said pressure chamber to drain into said reservoir, said back pressure removal means is adapted to act on said back pressure imparting means for removing said back pressure upon said workpiece stock filling said cavity.

6. A die system for full enclosed die forging in which an enclosed cavity is formed between an upper die attached to the side of a slide and a lower die mounted to the side of a bolster, and a workpiece stock disposed in the cavity is pressurized to be diverted with an upper counter-punch in the upper die and a lower counter-punch in the lower die and is thereby forged within the confines of the cavity, the system comprising:

a pressure means disposed in at least one of a first region above said upper die and a second region below said lower die for applying pressure to at least one of said upper and lower dies from at least one of their upper and lower sides to act to enclose said cavity at least unilaterally, said pressure means is disposed below said lower die for applying pressure to said lower die from its lower side to act to enclose said cavity unilaterally;

a back pressure imparting means comprising a cylinder actuator disposed in at least one of a third region above said upper counter-punch and a fourth region below said lower counter-punch for applying back pressure to at least one of said upper and lower counter-punches to force said workpiece stock being formed to be diverted at least unilaterally in said cavity, said back pressure imparting means is diposed above said upper counter-punch for applying back pressure thereto to force said workpiece stock being formed to be diverted unilaterally in said cavity; and a back pressure removal means comprising an electromagnetic valve via which a fluid pressure chamber of said cylinder actuator is connected to a fluid reservoir, for removing said back pressure immediately before an internal pressure of said cavity rises upon said workpiece stock filling said cavity, by opening said electromagnetic valve to permit a pressure fluid in said pressure chamber to drain into said reservoir, said back pressure removal means is adapted to act on said back pressure imparting means for removing said back pressure upon said workpiece stock filling said cavity.

* * * * *